US005892186A

United States Patent [19]

Flugger

[11] Patent Number: 5,892,186

[45] Date of Patent: Apr. 6, 1999

[54] MUFFLER WITH GAS-DISPERSING SHELL AND SOUND-ABSORPTION LAYERS

[75] Inventor: Ray T. Flugger, Forestville, Calif.

[73] Assignee: Flowmaster, Inc., Santa Rosa, Calif.

[21] Appl. No.: 963,110

[22] Filed: Nov. 3, 1997

[51] Int. Cl.[6] ..... F01N 1/10

[52] U.S. Cl. ..... 181/252; 181/255; 181/256; 181/269

[58] Field of Search ..... 181/227, 228, 181/249, 250, 251, 252, 255, 256, 257, 258, 264, 267, 269, 273, 282

[56] References Cited

U.S. PATENT DOCUMENTS 2,213,614 9/1940 Scarritt .
2,512,155 6/1950 Hill .

*Primary Examiner*—Khanh Dang
*Attorney, Agent, or Firm*—Flehr Hohbach Test Albritton & Herbert

[57] ABSTRACT

A muffler assembly (10) for use with internal combustion engines discharging hot exhaust gases. The muffler assembly includes an elongated casing (15) having an inlet opening (12) at one end and an outlet opening (13) at an opposite end. A sound attenuating partition assembly including a conically converging, perforated, dispersion shell (33) and a transverse wall (45) are provided inside the muffler casing (15). The dispersion shell (33) tapers inwardly by an amount resulting a cross sectional area ($A_3$) between the dispersion shell (33) and casing (15) at the transverse wall (45) which is at least equal to the area ($A_1$) of the inlet opening ($_{12}$). The combined area ($A_4$) of the perforations (46) in the dispersion shell (33) upstream of the transverse wall (45) also is at least about equal to the area ($A_1$) of the inlet opening (12). A perforated retaining shell (17) is provided positioned internally of the casing radially outwardly of the dispersion shell (33). An outer fiberglass layer of material (20) is positioned in the cavity (18) between the casing wall (15) and the retaining shell (17), and an inner ceramic layer of thermally insulating material (21) is positioned in the cavity (18) to thermally insulate the fiberglass layer (20) from the hot exhaust gases.

34 Claims, 3 Drawing Sheets

MUFFLER WITH GAS-DISPERSING SHELL AND SOUND-ABSORPTION LAYERS

TECHNICAL FIELD

The present invention relates to mufflers for internal combustion engines, and more particularly, relates to muffler assemblies of the type employing tubular, gas dispersion shells and to mufflers with sound absorption or attenuation materials.

BACKGROUND ART

High performance internal combustion engines of the type used on racing cars have been the subject of considerable empirical design work and some theoretical studies for both commercial and racing applications. The exhaust systems for these engines, however, are often treated secondarily by racing teams and car manufacturers in the effort to increase or maintain engine performance. Exhaust systems are conventionally regarded as decreasing engine horsepower, rather than being a possible source for increasing horsepower.

High performance engines are generally designed to provide peak power at higher engine speeds, and free flowing exhaust systems, and particularly mufflers, for such engines are highly advantageous. While a slight back pressure from the muffler system may aid engine acceleration at low engine speeds, at a high RPM, back pressure is highly undesirable.

Exhaust system induced back pressure tends to impair breathing of the motor, thereby limiting top end speed. Thus, for high speed performance minimizing the back pressure of the exhaust system is a primary consideration in exhaust system design.

Race cars, for example, normally run straight pipes, eliminating any type of muffler. This unattenuated or unsuppressed engine noise, however, is unacceptable and intolerable for non-race applications. In fact, even race tracks are now under pressure to reduce the noise levels during racing, especially at those tracks situated near urban areas.

The use of mufflers on conventional non-racing cars, of course, has been mandated by various laws in order to meet sound attenuation standards on public roadways. Original equipment muffler manufacturers for non-racing cars are only marginally concerned with the horsepower drop which occurs as a result of the muffler's sound attenuation. Performance-minded owners, therefore, tend to look to after-market muffler manufacturers for higher performance mufflers for their cars, while still keeping these cars "street legal," i.e., meeting the legal sound attenuation requirements.

For many years, therefore, there have been after-market muffler assemblies available which produce a throaty sports car exhaust sound, which sound is still within legal noise limits and which sound is accompanied by at least somewhat enhanced engine performance. One such after-market muffler has been produced in many similar versions, which versions are generally known as "glasspack" mufflers. These mufflers employ an elongated tubular casing having a layer of fiberglass material around the inner periphery of the casing, which fiberglass is retained in place in the casing by a perforated tubular shell mounted inside the casing. Various gas-directing partition or baffle structures have been used inside the fiberglass retaining shell to assist in dispersing gases and sound for attenuation, but in mufflers which generate the least back pressure, the gas dispersing baffling is minimal.

Glasspack mufflers initially have the desired sports car sound, but with time, the high gas temperatures and exhaust gas velocity break-down and erode away the fiberglass. This problem is exacerbated by cars which have catalytic converters because the exhaust gases reaching the muffler are much hotter. Fiberglass can withstand 800° F., but catalytic converters can raise the exhaust gas temperatures from 800° F. to about 1200° F., which greatly accelerates fiberglass breakdown.

Thermal erosion of fiberglass has been addressed by substituting a ceramic fiber blanket as a sound attenuation means in mufflers. While this approach has been suitable to address the thermal breakdown problems caused by the heat of the exhaust gases as they pass through the muffler, high velocity of the exhaust gases still erode ceramic blankets.

The use of partitions in glasspack mufflers to attenuate sound has been accompanied by three undesirable side effects. First, the partitions have tended to increase back pressure by choking flow through the muffler. Second, the partitions have often increased exhaust gas velocity proximate the fiberglass, thus increasing the rate of fiberglass erosion and breakdown. Thus, to the extent that glasspack mufflers are essentially straight-through mufflers (do not include sound attenuating dispersion partitions) sound attenuation is reduced. If they include sound attenuating, gas-dispersing, partition structures, back pressure and fiberglass erosion have been undesirably high. Third, glasspack mufflers also have a tendency to rap (make a cracking sound) during acceleration and deceleration. This is also known as "school busing" and is caused by sound waves that are not allowed to expand.

As a result of these problems, glasspack mufflers are considerably less popular in the muffler after market than was the case 20 or 30 years ago.

DISCLOSURE OF THE INVENTION

Accordingly, it is an object of the present invention to provide a muffler assembly for an internal combustion engine which has a partition structure that disperses gases and entrained sound through the muffler for sound attenuation without substantially choking or restricting gas flow in the muffler.

It is still another object of the present invention to provide a muffler assembly which attenuates engine exhaust noise without substantial adverse affects on engine performance.

Another object of the present invention is to provide a fiberglass muffler assembly with reduced thermal and exhaust gas velocity erosion and breakdown of the fiberglass components due to the heated exhaust gases.

Yet another object of the present invention is to provide a muffler assembly packed with a sound-attenuating material which has an increased operating longevity.

It is another object of the present invention to provide a sound attenuating muffler which prevents "school busing," is durable, compact, easy to maintain, has a minimum number of components and is economical to manufacture.

In accordance with the foregoing objects, a muffler assembly is provided for use with internal combustion engines discharging hot exhaust gases. The muffler assembly includes an elongated casing having an inlet opening at one end and an outlet opening at an opposite end. An elongated gas dispersing shell is positioned radially inwardly of the casing wall for receipt of exhaust gases from the inlet opening. The gas dispersing shell is perforated for the flow of exhaust gases into a space between the casing wall and dispersing shell. Moreover, the dispersing shell converges inwardly from the casing inlet to a transverse partition or wall extending across the casing at about a central portion of the casing. The dispersing shell converges by an amount resulting in the area of the space between the casing wall and the dispersing shell at the transverse wall being at least substantially equal to the area of the casing inlet opening, and the combined areas of the dispersing shell perforations in advance of the transverse wall are also at least substantially equal to the area of the casing inlet opening. Thus, exhaust gases can flow around the transverse wall for attenuation of the noise component substantially without choking. The present invention muffler assembly also preferably includes an outer fiberglass layer of material positioned in the casing proximate the casing wall, and an inner ceramic layer of material positioned between retaining shell and the fiberglass layer of material and a second perforated retaining shell mounted concentrically and outwardly of the dispersing shell. The ceramic layer of material is of a sufficient thickness to thermally insulate the fiberglass layer of material from the hot exhaust gases by an amount significantly reducing fiberglass breakdown.

BRIEF DESCRIPTION OF THE DRAWINGS

The assembly of the present invention has other objects and features of advantage which will be more readily apparent from the following description of the BEST MODE OF CARRYING OUT THE INVENTION and the appended claims, when taken in conjunction with the accompanying drawing, in which:

BEST MODE FOR CARRYING OUT THE INVENTION

While the present invention has been described with reference to a few specific preferred embodiments, the description is illustrative of the invention and is not to be construed as limiting the invention. Various modifications may occur to those skilled in the art without departing from the true spirit and scope of the invention as defined by the appended claims.

Figure 1:
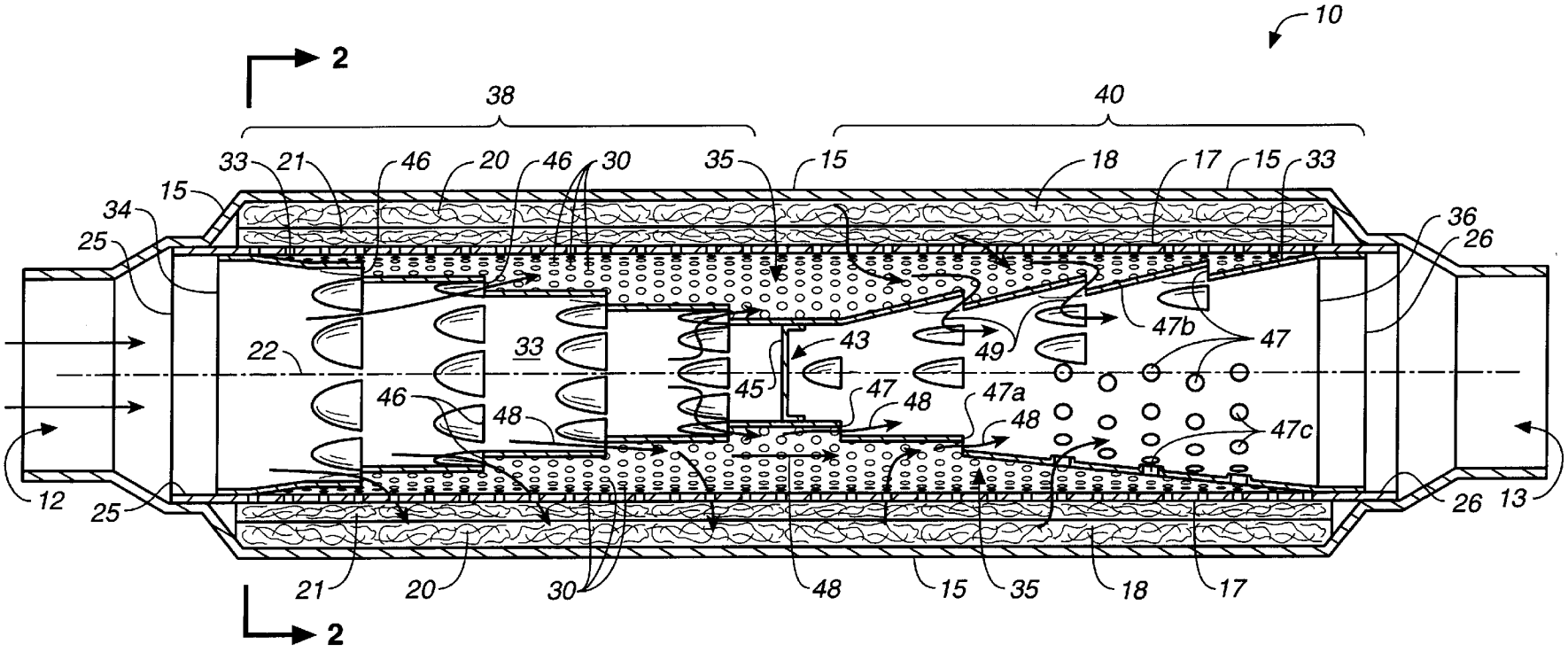
FIG. 1 is a side elevation view, in cross section, of a muffler assembly constructed in accordance with the present invention.

Referring now to FIG. 1, a muffler assembly, generally designated 10, is shown which achieves the above-mentioned objectives. Muffler 10 is primarily for use with internal combustion engines which discharge hot exhaust gases, but it could have other sound attenuating applications. The muffler assembly includes an elongated casing 15 having an inlet opening 12 at one end, an outlet opening 13 at an opposite end thereof. Casing wall 15 defines a casing interior or passageway which extends from inlet opening 12 to outlet opening 13. In a first aspect of muffler 10, internal partitioning is provided to increase sound attenuation, but the partitioning is constructed in a manner which does not substantially restrict or choke exhaust gas flow. Most preferably, the partitioning system of the present invention is employed in combination with sound attenuating material, such as fiberglass, but in the first aspect of the invention such sound attenuating material is not required.

In a second aspect of the present invention, a fiberglass packed muffler is provided which has improved resistance to fiberglass breakdown and erosion. In this aspect of the invention, the improved fiberglass system can be used with a straight-through muffler or, more preferably, with the improved partitioning system of the first aspect of the invention.

The sound attenuating partition system of the present invention includes an elongated gas dispersing shell, generally designated 33, disposed inside casing 15 in radially inwardly spaced, and preferably concentric, relation thereto. Dispersing shell 33 is preferably provided by a tubular (conical) member which convergently tapers from inlet end 34 of the shell to a central portion 43 and diverges from central portion 43 to outlet end 36. Dispersion shell 33 further is perforated or formed with a plurality of openings at 46 to enable the flow of hot gases and entrained sound through the dispersion shell and into a space 35 between casing wall 15 and shell 33.

The use of conical partition assemblies in mufflers is well known. For example, U.S. Pat. No. 2,512,155 discloses a converging-diverging conical shell assembly inside a muffler housing. This muffler does not have any transverse wall or partition so that sound waves can pass directly from the inlet to the outlet at the central axis of the muffler, and the muffler does not include sound-attenuating fiberglass or ceramic. See also, U.S. Pat. No. 2,213,614 which has similar deficiencies.

In order to prevent the direct passage of the sound component of the exhaust gases through muffler 10 from the inlet to the outlet, the partition system of the present invention includes a transverse wall, partition or member 45 which extends across dispersion shell 33 at a point between the inlet and outlet ends 34 and 36, most preferably, but not necessarily, at about the mid-length or central portion 43 of the shell. Wall 45 blocks or greatly restricts the direct transmission of the gas-entrained noise component through the casing and forces the hot gases and sound to disperse outwardly through perforations 46 into space 35. Downstream of wall 45, both hot gases and noise components must converge back together, preferably through a plurality of openings or perforations 47 in dispersion shell 33, before flowing out casing outlet opening 13.

The provision of dispersion shell 33 with a transverse wall or restriction 45 is effective in attenuating noise by substantially reducing straight-through transmission of sound and by causing noise components to converge together and thereby achieve sound frequency cancellation. As described so far, therefore, muffler assembly 10 achieves significant sound attenuation over a straight pipe, but such sound attenuation should not be accomplished at the expense of a substantial increase in muffler induced back pressure.

Figure 4:
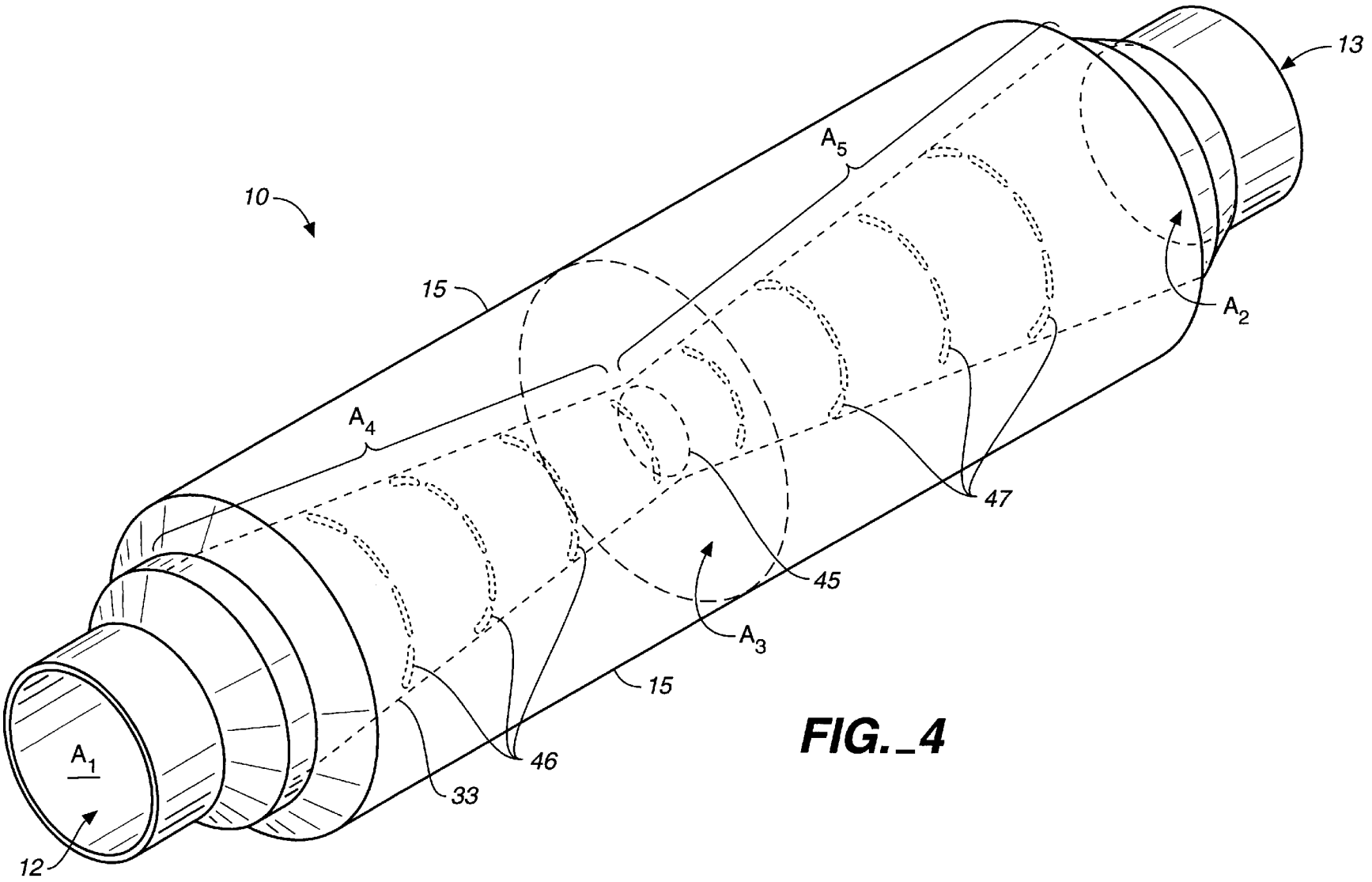
FIG. 4 is a schematic top perspective view of the muffler assembly of FIGS. 1 and 2.

In the improved partition system of the present invention, dispersing shell 33 is further formed to convergently taper from end 34 to transverse wall 45 by an amount which results in a transverse cross sectional area at wall 45, between shell 33 and casing 15, which is at least about substantially equal to the transverse cross sectional area of inlet opening 12. As best may be seen in FIG. 4, muffler 10 will have an inlet opening area, $A_1$, which will have been selected to have a size so as not to choke or restrict the flow of exhaust gases from a header pipe into the muffler. Similarly, the area, $A_2$, of outlet opening 13 will be at least as large as inlet opening area $A_1$. This is conventional in the muffler art, but unfortunately, little consideration has previously been given to internal muffler area restrictions. In the present muffler assembly, however, dispersion shell 33 tapers or steps inwardly until the area, $A_3$, at wall 45 between shell 33 and casing 15 is at least equal to inlet area $A_1$.

Moreover, the combined area, $A_4$, of perforations 46 upstream of transverse wall 45 also will have an area substantially equal to or greater than the transverse area $A_1$ of inlet opening 12. As will be apparent, therefore, exhaust gases passing through opening 12 and traveling along the interior of conical dispersing shell 33 will be able to pass through perforations 46 and around and beyond transverse wall 45 without encountering an area more restricted than the inlet opening 12 to casing 15.

Moreover, by converging or inwardly tapering dispersing shell 33 between inlet opening 12 and wall 45, muffler 10 can be formed with the smallest exterior diameter, or transverse casing cross section possible without restricting gas flow. As dispersing shell 33 converges, cross sectional area $A_3$ between shell 33 and casing wall 15 increases. If dispersion shell 33 were cylindrical (not convergently tapered), outer casing wall 15 would have to have a greater diameter to enable flow around transverse wall 45 without an area restriction, than is the case for the convergently tapered dispersion shell 33 of the present invention. Enlarging casing diameter 15 results in rapidly increasing casing or muffler weight, as well as undesirably increasing the muffler's size.

In the preferred form, dispersing shell 33 extends beyond transverse wall 45, which will be described in detail below, but in the broadest aspect, conical shell 33 could terminate at wall 45.

In the second aspect of the present invention, a muffler is provided which has sound attenuating material in it that is highly effective and yet will not breakdown rapidly under today's higher exhaust gas temperatures. The details of the preferred system of providing sound attenuating materials in muffler 10 may now be described.

In order to achieve further sound attenuation, it is preferable to include a sound attenuating material inside casing 15, such as a layer of fiberglass material 20. As has been conventional, fiberglass layer 20 can be held in place by a perforated retaining shell, generally designated 17. Exhaust gas sound components, entrained in the flowing gas, are directed outwardly by dispersing shell 33 and transverse wall 45 and they will impinge upon and be attenuated by fiberglass layer 20. The volume of the flow of exhaust gases in the sound attenuating layer 20 (and in layer 21) will be minimal. Thus, the transverse cross sectional area $A_3$ at transverse wall 45 will be reduced by retaining shell 17 and the sound attenuating material. Again, however, area $A_3$, between shells 33 and 17 at wall 45, will be selected to be at least equal to area $A_1$ of inlet opening 12. It is primarily the sound component of the exhaust gases, as well as some gases moving at relatively low velocity, which enter the annular space 18 between shell 17 and casing 15.

There is, therefore, an increase in casing diameter resulting from the use of a sound attenuating layer, but there also is a substantial increase in sound attenuation. Moreover, the inwardly tapering dispersing shell 33 allows casing diameter to be minimized for a muffler which also includes sound attenuating material.

In order to reduce erosion and thermal breakdown of fiberglass layer 20, muffler assembly 10 further includes an inner ceramic fiber layer of material, generally designated 21, positioned in cavity 18 between retaining shell 17 and fiberglass layer of material 20. Ceramic layer of material 21 is of a sufficient thickness to thermally insulate the fiberglass material from the hot exhaust gases by an amount sufficient to prevent rapid breakdown of the fiberglass. In the most preferred form, a ceramic fiber woven blanket 21 is provided and thermally insulates fiberglass blanket or layer 20 from the exhaust gases. Ceramic blanket 21 reduces the temperature of the exhaust gases contacting layer 21 of the fiberglass, preferably to a temperature below 800° F., and most preferably well below that temperature. Outer fiberglass layer 21 is a highly effective sound attenuating material while inner ceramic layer 20 is a good thermal insulator. Consequently, the operation life of muffler assembly 10 will be increased over conventional glasspack mufflers.

FIG. 1 illustrates that elongated casing 11 extends along longitudinal axis 22 and preferably is cylindrical in shape, although other cross sections are suitable for both aspects of the present invention. Retaining shell 17 is also preferably cylindrically shaped and concentrically mounted within casing 15. Shell 17 has a wall thickness sufficient to withstand the exhaust gas temperature while maintaining its structural integrity, as is well known in the art.

The one end 25 of retaining shell 17 is advantageously mounted or coupled to an inner surface of wall 15 proximate the casing inlet opening 12, while an opposite end 26 of retaining shell 17 is mounted or coupled to wall 15 proximate the casing outlet opening 13. Retaining shell 17 is radially inwardly spaced apart from casing wall 15 forming cavity or space 18 therebetween. As best viewed in FIG. 2, cavity 18 is preferably annularly shaped and FIG. 1 further illustrates that retaining shell 17 includes a plurality of relatively small diameter apertures 30 extending therethrough to enable communication between diverging/converging frusto-conical space 35 and cavity 18. Apertures 30 are spaced apart and positioned side-by-side from the one end to the opposite end of the retaining shell. Adjacent rows of apertures preferably are staggered or offset, as commonly employed with perforated sheet materials.

Apertures 30 are constructed as small as possible without substantially weakening the integrity of the structure. A desired cumulative open area of the apertures 30 in sheet steel material of 18 gauge is, for example, up to at least 40% of the total surface area of retaining shell 17. A diameter of about 1/16th inch has been found acceptable for apertures 30. Such perforated materials are commercially available and manufactured by DIAMOND MANUFACTURING COMPANY of Pennsylvania, USA.

As set forth above, sound absorption fiberglass blanket 20 is positioned in annular cavity 18 and has an annular cross section. Preferably, the fiberglass blanket extends substantially from one end of annular cavity 18, proximate the casing inlet opening 12, to an opposite end of the annular cavity, proximate casing outlet opening 13. The fiberglass blanket preferably is about ¾ inch thick, and is a long strand woven fiberglass mat that has been stitched with longer glass threads. The structure is particularly suitable for enhancing sound attenuation and is well known in the industry.

To insulate fiberglass blanket 20 from thermal erosion and deterioration caused by hot exhaust gases passing into cavity 18, ceramic woven blanket 21 is situated between fiberglass layer 20 and retaining shell 17 in cavity 18. Similar to the fiberglass blanket, ceramic fiber layer 21 may have an annular cross section (FIG. 2), and preferably it extends end-to-end in annular cavity 18, substantially shielding and thermally insulating fiberglass layer 20 from hot exhaust gases. Hence, as the hot exhaust gases pass into cavity 18 through apertures 30, fiberglass blanket 20 is thermally insulated by ceramic fiber blanket 21.

The ceramic fiber woven material is capable of a service temperature up to between about 2300° F. and 3000° F. However, the ceramic fiber material is also very fragile and requires sufficient support to prevent the exhaust gases from fragmenting the fibers of the ceramic material. The fibers of the fiberglass material interlock to a degree with the ceramic fibers and provide the necessary support to reinforce the ceramic material. In addition, the retaining shell 17 provides additional mechanical support by sandwiching the ceramic layer between the fiberglass layer and casing 15. It has been observed that as little as a ½ inch thick barrier of woven ceramic material is capable of reducing the temperature of the exhaust gases at the boundary layer by as much as 50%. The preferred thickness of the ceramic layer is between about ¼ inch to about ¾ inch and, most preferably, about ½ inch. One such ceramic fiber blanket is that commercially available through COTRONICS CORPORATION of New York, USA.

Returning now to the details of construction of dispersing shell 33, end 34 of dispersing shell 33 is mounted or coupled to either casing wall 15 or to retaining shell 17, proximate the casing inlet opening 12. Moreover, in the preferred form, dispersing shell extends over substantially the full length of casing 15 and has opposite end 36 mounted or coupled to either casing wall 15 or retaining shell 17 proximate the casing outlet opening 13.

FIG. 1 illustrates that dispersing shell 33 is preferably shaped as a converging/diverging frusto-conical tubular member. An inlet length 38 of shell 33 tapers or steps inwardly from inlet opening 12 to a central portion 43, while a downstream outlet portion 40 of dispersing shell 33 tapers or steps outwardly from central portion 43 to casing outlet opening 13.

Figure 2:
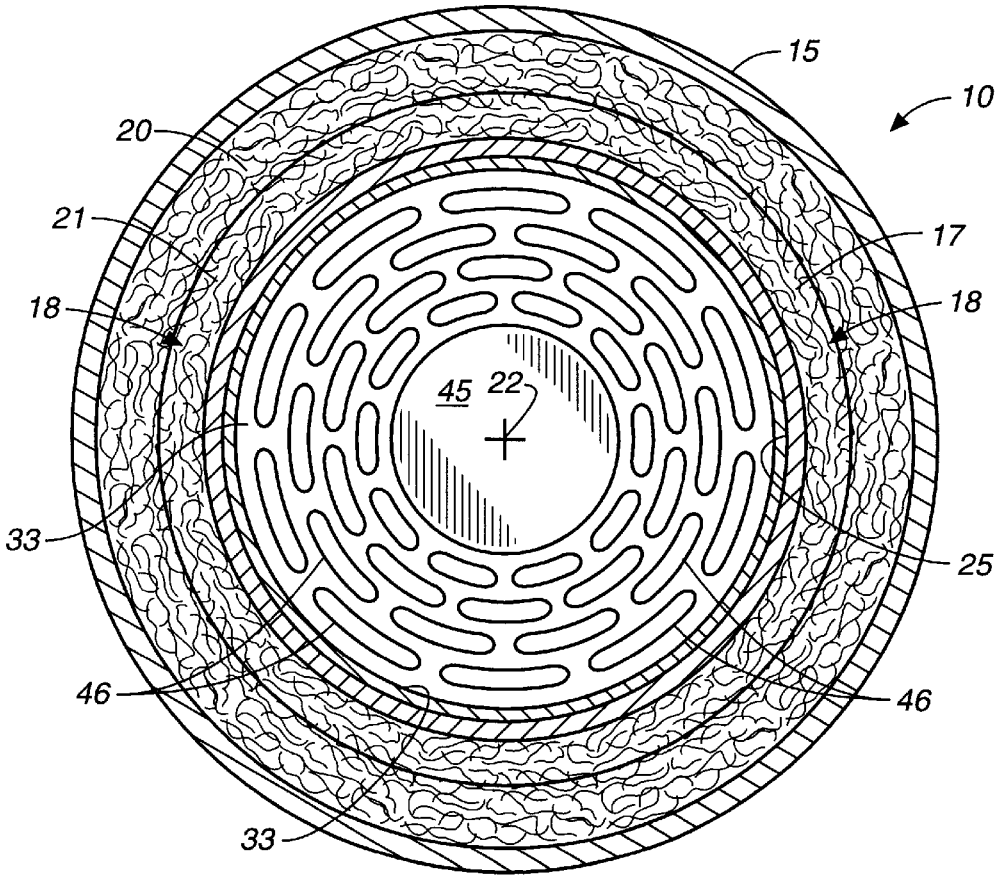
FIG. 2 is an enlarged front elevation view, in cross section, of the muffler assembly of the present invention, taken substantially along the plane of the line 2—2 in FIG. 1.

To facilitate dispersion of the exhaust gases radially outwardly around transverse wall 45, dispersing shell 33 includes openings or perforations 46 which advantageously may be provided by louvers. In the preferred form, inlet length 38 is louvered such that the inlet louvers 46 are oriented to have openings facing substantially in the direction of inlet opening 12. As shown in FIGS. 1 and 2, inlet orifices 46 may be oblong shaped and extend arcuately or circumferentially about longitudinal casing axis 22. Louvers 46 facing inlet 12 offer less resistance to incoming exhaust gas flow than louvers facing away from the inlet opening or perforations perpendicular to the inlet opening. This orientation of louvers 46 combines with the combined area $A_4$ of louver openings 46 to ensure minimal resistance to through flow in muffler 10.

It should be noted, however, that for street applications or lower horsepower engines, louvered inlet orifices 46 are not critical. In these instances, standard or conventional perforated sheet materials may be substituted, such as the staggered center aperture designs used in retaining shell 17 and the perforated cones shown in U.S. Pat. No. 2,512,155. It will be appreciated, however, that the cumulative surface area $A_4$ of inlet orifices 46 still should be at least equal to the transverse cross sectional area $A_1$ of inlet opening 12, which concept is not taught in U.S. Pat. No. 2,512,155.

At the perforated outlet length 40 of dispersing shell 33, a plurality of outlet orifices 47 are provided. These orifices enable exhaust communication between diverging/converging frusto-conical space 35 and the interior of dispersing shell 33. For high horsepower engines, outlet orifices 47 again may be louvered, similar to the louvered inlet orifices 46, to enhance performance. However, the configuration of outlet orifices 47 is generally not as critical as that of inlet orifices 46 since the exhaust gases in annular 35 will be flowing toward outlet opening 13 and will follow the path of least resistance in doing so. The use of louvers, per se, is not regarded as being new in that U.S. Pat. No. 2,213,614 discloses louvered internal muffler shells or partitions.

FIG. 1 illustrates three different outlet orifice configurations which may be employed. In the first configuration, the outlet orifice 47*a* is louvered and has an open area to the interior of shell 33 facing casing inlet opening 12, similar to the inlet orifices 46. As shown by exhaust path arrows 48, the path of least resistance is followed as the gases flow in a substantially straight line from inlet opening 12 through louvers 46, into space 35, and from space 35 through louver 47*a* to outlet opening 13. Hence, some of the exhaust flow and the entrained sound component will pass relatively directly through the muffler with less sound attenuation. This first outlet orifice configuration 47*a* provides the least back pressure and, hence, is more suitable for race applications. The problem with this configuration, however, is that the muffler is inherently louder than other configurations.

In the second outlet orifice configuration, as designated by outlet orifice 47*b* in FIG. 1, the louvered outlet orifice has an area which faces away from casing outlet opening 13. As represented by arrows 49, the path of least resistance traveled through outlet orifice 47*b* is greater and more circuitous than the path of least resistance traveled through outlet orifice 47*a* (represented by arrow 48). This second louver configuration will slightly increase back pressure, but because there is no straight path between inlet opening 12 and outlet opening 13, it will tend to attenuate exhaust noise components to a greater degree. Hence, this configuration is more conducive to street applications.

By combining these two configurations, the long and short paths of travel of the exhaust gases can be varied, enabling customization of the muffler sound and back pressure. Further, a third outlet orifice configuration, as designated by outlet orifice 47*c* in FIG. 1, may be included for lower performance applications. In this instance, standard or conventional perforated sheeting may be used, such as the staggered center aperture design of retaining shell 17 above discussed. It will be understood, however, that the cumulative surface area $A_5$ of outlet orifices 47 again should be at least equal to the transverse cross sectional area $A_1$ of inlet opening 12.

Perforations are less expensive to form than louvers, however, perforations induce a radial component in gas flow. Accordingly, louvers are most preferred in the converging section of shell 33 at the inlet end of the muffler in order to reduce gas velocity directed outwardly toward the fiberglass and ceramic layers. In the diverging section of shell 33 proximate outlet 13, gases are returning inwardly from space 35 to the center of the muffler. Accordingly, perforations 47*c* are preferred since erosion is not an issue and simple perforations 47*c* in shell 33 are less expensive to form than louvers, 47*a*,47*b*.

Figure 3:
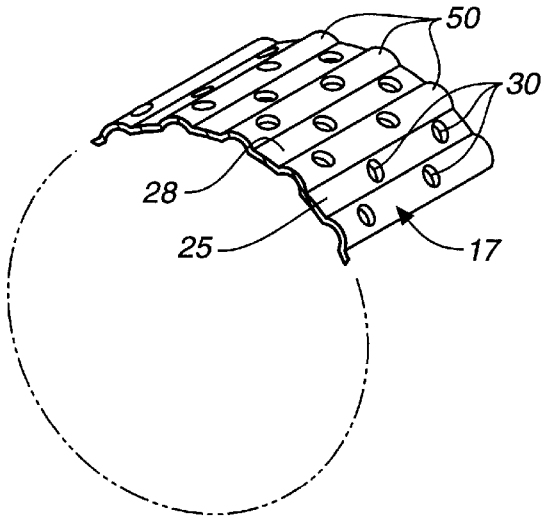
FIG. 3 is a reduced, fragmentary, top perspective view of a portion of an alternative embodiment of the perforated retaining shell of the present invention showing elongated strengthening ribs.

In an alternative embodiment of the present invention, as shown in FIG. 3, retaining shell 17 includes strengthening ribs 50 extending longitudinally thereof. These ribs provide additional strength to the perforated retaining material which enable the use of thinner or lighter gauge sheet material to save weight. Moreover, this ribbing arrangement adds surface area which is suitable for reflecting sound waves at varying angles for dispersion inside casing 15. One more beneficial feature of ribbing 50 is that it facilitates gas flow in a direction along axis 22 thereby reducing eddy currents and undesirable swirling of gases.

What is claimed is:

1. A muffler assembly for use with an internal combustion engine discharging exhaust gases comprising:

an elongated imperforate casing having an inlet opening at one end and an outlet opening at an opposite end;

an elongated gas dispersing shell positioned inside said casing in radially inwardly spaced relation thereto for receipt of exhaust gases from said inlet opening into an interior of said shell, said dispersing shell has a plurality of openings for the flow of exhaust gases between said interior to a space between said casing and said dispersing shell;

a transverse partition extending across said dispersing shell at a spaced distance from said inlet opening; and said dispersing shell being convergently tapered between said inlet opening and said partition by an amount resulting in the area of said space between said dispersing shell and said casing at said partition being at least substantially equal to the area of said inlet opening, and said plurality of openings in said dispersing shell between said inlet opening and said partition having a combined area at least substantially equal to the area of said inlet opening.

2. The muffler assembly as defined in claim 1 wherein, said dispersing shell is mounted in substantially concentric relation with said casing and extends over substantially the full length of said casing.

3. The muffler assembly as defined in claim 2 wherein, said partition extends across said dispersing shell at about a midpoint of the length of said casing;

said dispersing shell has a plurality of openings between said partition and said outlet opening and has said plurality of openings between said partitions and said outlet opening having a combined area at least substantially equal to the area of said inlet opening; and said dispersing shell is divergently tapered between said partition and said outlet opening.

4. The muffler assembly as defined in claim 3 wherein, said casing is substantially cylindrical; and said dispersing shell is substantially convergently frusto-conical from said inlet opening to said partition and divergently frusto-conical from said partition to said outlet opening.

5. The muffler assembly as defined in claim 3, and a layer of sound attenuating material positioned in said space proximate an interior surface of said casing.

6. The muffler assembly as defined in claim 5, and an elongated perforated retaining shell positioned in said casing between said dispersing shell and said sound attenuating material and formed to retain said sound attenuating material proximate said interior surface of said casing.

7. The muffler assembly as defined in claim 6 wherein, said retaining shell has a first open end coupled to the casing inlet and an opposite second open end coupled to the casing outlet such that said retaining shell substantially extends from said inlet opening to said outlet opening for flow of the exhaust gases therethrough.

8. The muffler assembly as defined in claim 6 wherein, said retaining shell includes a plurality of strengthening ribs extending longitudinally in said casing.

9. The muffler assembly as defined in claim 6 wherein, said retaining shell includes a plurality of relatively small diameter apertures therethrough, said apertures having a cumulative area of at least about 40% of the surface area of said retaining shell.

10. The muffler assembly as defined in claim 3 wherein, said plurality of openings in said dispersion shell between said inlet opening and said partition are provided by louvers oriented to face substantially in the direction of said inlet opening.

11. The muffler assembly as defined in claim 3 wherein, said plurality of openings in said dispersion shell between said partition and said outlet opening are provided by radially oriented perforations.

12. The muffler assembly as defined in claim 6 wherein, said sound attenuating material includes a layer of fiberglass material positioned proximate said casing, and a layer of ceramic material positioned between said fiberglass material and said retaining shell.

13. The muffler assembly as defined in claim 12 wherein, said fiberglass material is provided by a woven fiberglass blanket, and said ceramic material is provided by a woven ceramic blanket.

14. A lightweight muffler assembly for use with an internal combustion engine discharging hot exhaust gases comprising:

an elongated casing having an inlet opening at one end, an outlet opening at an opposite end, and an imperforate casing wall therebetween;

a perforated retaining shell positioned internally of the casing in inwardly spaced relation thereto for flow of exhaust gases along a portion of said retaining shell during flow of said exhaust gases from said inlet opening through said casing to said outlet opening, said retaining shell and said casing wall defining a cavity therebetween, and the perforated retaining shell further being formed for communication of exhaust gases to said cavity;

an outer layer of fiberglass material positioned in said cavity proximate said casing wall; and an inner layer of ceramic fiber material positioned in said cavity and supported by and between said retaining shell and said fiberglass material, and said layer of ceramic fiber material having a thickness of at least about ¼ inch to thermally insulate said fiberglass material from the hot exhaust gases during passage of the same into said cavity by an amount significantly reducing thermal breakdown of said fiberglass material.

15. The muffler assembly as defined in claim 14 wherein, the thickness of said layer of ceramic fiber material is about ½ inch.

16. The muffler assembly as defined in claim 14 wherein, said layer of ceramic fiber material is provided by a ceramic woven blanket.

17. The muffler assembly as defined in claim 16 wherein, said ceramic woven blanket is provided by a long strand ceramic fiber blanket.

18. The muffler assembly as defined in claim 14 wherein, said fiberglass material is provided by a long strand woven fiberglass blanket.

19. The muffler assembly as defined in claim 14 wherein, said retaining shell is elongated having a first open end coupled to said casing wall proximate said inlet opening and an opposite second open end coupled to said casing wall proximate said outlet opening such that said retaining shell substantially extends from said inlet opening to said outlet opening for flow of the exhaust gases therethrough.

20. The muffler assembly as defined in claim 19 wherein, said retaining shell includes a plurality of elongated strengthening ribs extending longitudinally therealong.

21. The muffler assembly as defined in claim 19 wherein, said casing is substantially cylindrical, and said retaining shell is substantially cylindrical and mounted in concentric relationship to said casing.

22. The muffler assembly as defined in claim 14 wherein, said retaining shell includes a plurality of relatively small diameter apertures having a cumulative area of at least about 40% of the surface area of said retaining shell.

23. The muffler assembly as defined in claim 22 wherein, each of said apertures is less than about ⅛ inch in diameter.

24. The muffler assembly as defined in claim 23 wherein, each of said apertures is about 1/16 inch in diameter.

25. A lightweight muffler assembly for use with an internal combustion engine discharging hot exhaust gases comprising:

an elongated casing having an inlet opening at one end, an outlet opening at an opposite end, and an imperforate casing wall therebetween;

a perforated retaining shell positioned internally of the casing wall in inwardly spaced relation thereto for flow of exhaust gases along a portion of said retaining shell during flow of said exhaust gases from said inlet opening through said casing to said outlet opening, said retaining shell and said casing wall defining a cavity therebetween, and the perforated retaining shell further enabling communication of exhaust gases to said cavity;

a hollow, perforated dispersing shell positioned radially inwardly of said retaining shell in said casing for flow of the exhaust gases along a portion of said dispersing shell from said inlet opening toward said outlet opening, said dispersing shell and said retaining shell defining an annular chamber therebetween;

an outer layer of fiberglass material positioned in said cavity proximate said casing wall; and an inner layer of ceramic fiber material positioned in said cavity between said retaining shell and said fiberglass material, and said ceramic material being of a sufficient thickness to thermally insulate said fiberglass material from the hot exhaust gases during passage of the same into said cavity by an amount reducing thermal breakdown of said fiberglass material.

26. The muffler assembly as defined in claim 25 wherein, said dispersing shell having an inlet portion tapering inwardly from proximate said inlet opening toward a central portion of said shell, said inlet portion being formed with a plurality of inlet orifices for communication of exhaust gases from an interior of the dispersing shell to said chamber.

27. The muffler assembly as defined in claim 26 wherein, said dispersing shell further includes an end wall coupled thereto and extending transversely across said dispersing shell at a central portion thereof to redirect flow of exhaust gases from an interior of said dispersing shell to said chamber.

28. The muffler assembly as defined in claim 27 wherein, said inlet portion is louvered such that said inlet orifices are oriented to substantially face in the direction of said inlet opening.

29. The muffler assembly as defined in claim 28 wherein, the cumulative area of said inlet orifices is equal to at least the transverse cross sectional area of said inlet opening to said casing.

30. The muffler assembly as defined in claim 27 wherein, the cumulative transverse cross sectional area of said chamber at said end wall is equal to at least the transverse cross sectional area of the inlet opening.

31. The muffler assembly as defined in claim 27 wherein, said retaining shell further includes an outlet portion tapering outwardly from said central portion to proximate said outlet opening, said outlet portion including a plurality of outlet orifices for communication of gases from said chamber to an interior of said dispersing shell proximate said outlet opening.

32. The muffler assembly as defined in claim 31 wherein, said outlet portion is louvered with outlet orifices oriented to face substantially in the direction of said inlet opening.

33. The muffler assembly as defined in claim 31 wherein, said outlet portion is louvered with outlet orifices oriented to face substantially in the direction of said outlet opening.

34. The muffler assembly as defined in claim 31 wherein, the cumulative area of said outlet orifices is at least about equal to the transverse cross sectional area of said inlet opening.

* * * * *